US009598957B2

(12) United States Patent
Kruspe

(10) Patent No.: US 9,598,957 B2
(45) Date of Patent: Mar. 21, 2017

(54) SWITCHABLE MAGNETIC PARTICLE FILTER

(71) Applicant: BAKER HUGHES INCORPORATED, Houston, TX (US)

(72) Inventor: Thomas Kruspe, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 523 days.

(21) Appl. No.: 13/946,598

(22) Filed: Jul. 19, 2013

(65) Prior Publication Data

US 2015/0021034 A1 Jan. 22, 2015

(51) Int. Cl.
*E21B 49/10* (2006.01)
*E21B 49/08* (2006.01)

(52) U.S. Cl.
CPC ..... *E21B 49/10* (2013.01); *E21B 2049/085* (2013.01)

(58) Field of Classification Search
None
See application file for complete search history.

(56) References Cited

U.S. PATENT DOCUMENTS 2,117,361 A 5/1938 Rohrbach
2,925,650 A 2/1960 Pall
3,035,703 A * 5/1962 Pall ..... B01D 35/06 210/223
3,049,796 A 8/1962 Pall
3,477,948 A 11/1969 Kiyoshi
3,581,898 A * 6/1971 Tyrrell ..... B01D 35/02 210/222
3,690,606 A 9/1972 Pall
4,352,730 A 10/1982 Dijkhuis
4,432,873 A 2/1984 Schuster
4,544,482 A 10/1985 Rupp
4,605,678 A 8/1986 Brennan et al.
5,356,015 A 10/1994 Notebaart et al.
5,989,435 A 11/1999 Herman et al.
6,099,739 A * 8/2000 Kobayashi ..... B03C 1/282 210/103
6,649,054 B2 11/2003 Iida et al.
(Continued)

OTHER PUBLICATIONS

Int'l Search Report & Written Opinion in PCT/US2014/045412, dtd Oct. 20, 2014.

*Primary Examiner* — Jennifer H Gay
*Assistant Examiner* — Caroline Butcher
(74) *Attorney, Agent, or Firm* — Mossman Kumar & Tyler PC

(57) ABSTRACT

Systems, devices and methods for evaluating a downhole fluid from a borehole intersecting an earth formation. The method may include filtering magnetic particles in the downhole fluid by activating a switchable magnetic filter when the downhole fluid enters a sample chamber in the borehole. The filter may include a wire mesh comprising strands of conductor oriented in a first direction; and strands of soft magnetic material oriented in a second direction. The method may also include cleaning the switchable magnetic filter by deactivating the switchable magnetic filter. Cleaning the switchable magnetic filter may include removing filtered particles using a fluid. The method may further include estimating a parameter of interest of the downhole fluid in the sample chamber.

12 Claims, 6 Drawing Sheets

(56) References Cited

U.S. PATENT DOCUMENTS

| | | | | |
|---|---|---|---|---|
| 6,871,713 | B2 | 3/2005 | Meister et al. | |
| 2002/0096464 | A1 | 7/2002 | Simonson | |
| 2003/0006768 | A1 | 1/2003 | Kleinberg et al. | |
| 2009/0218145 | A1 | 9/2009 | Branch | |
| 2010/0218943 | A1* | 9/2010 | Nold, III | E21B 49/10 166/264 |
| 2012/0227483 | A1 | 9/2012 | Kruspe et al. | |

* cited by examiner

SWITCHABLE MAGNETIC PARTICLE FILTER

FIELD OF THE DISCLOSURE

This disclosure relates generally to investigations of underground formations and more particularly to systems and methods for sampling and testing downhole fluids within a borehole.

BACKGROUND

Commercial development of hydrocarbon fields requires significant amounts of capital. Before field development begins, operators desire to have as much data as possible in order to evaluate the reservoir for commercial viability. It is often desirable to conduct testing of the hydrocarbon reservoirs in order to obtain useful data. Therefore, during drilling or after a borehole for a well has been drilled, hydrocarbon zones are often tested with tools that acquire fluid samples, e.g., liquids from downhole.

SUMMARY OF THE DISCLOSURE

In aspects, the present disclosure provides methods for evaluating a downhole fluid from a borehole intersecting an earth formation. The method may include filtering magnetic particles in downhole fluid by activating a switchable magnetic filter when the downhole fluid enters a sample chamber in the borehole. The method may also include cleaning the switchable magnetic filter by deactivating the switchable magnetic filter. Cleaning the switchable magnetic filter may include removing filtered particles using a fluid. The fluid may be at least one of: i) the downhole fluid; and ii) engineered fluid. The method may further include estimating a parameter of interest of the downhole fluid in the sample chamber. The downhole fluid may include at least one of i) formation fluid; and ii) wellbore fluid.

In aspects, the present disclosure includes a formation evaluation apparatus. The apparatus may include a sample chamber configured to receive downhole fluid; a switchable magnetic filter configured to, when activated, filter magnetic particles from downhole fluid entering the sample chamber. The switchable magnetic filter may be further configured to, when deactivated, relax to substantially no magnetization. The apparatus may include a sensor responsive to a parameter of interest of the downhole fluid in the sample chamber and sensitive to magnetic particles.

In the above aspects, the switchable magnetic filter may include at least one wire mesh. The at least one wire mesh may include strands of conductor oriented in a first direction; and strands of soft magnetic material oriented in a second direction that is different from the first direction. The conductor strands may be electrically isolated. The switchable magnetic filter may be switchable between a magnetic state producing a magnetic field and a non-magnetic state producing substantially no magnetic field.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals.

DETAILED DESCRIPTION

In aspects, the present disclosure relates to devices and methods for evaluating a downhole fluid from a borehole intersecting an earth formation. In particular, embodiments of the present disclosure minimize, if not eliminate, magnetic particles fouling of magnetically sensitive sensors of downhole fluid sampling instruments. The method may further include estimating a parameter of interest of the downhole fluid in the sample chamber using measurements from the instruments. Illustrative techniques according to this disclosure employ a switchable magnetic filter to ensure that magnetic particles do not enter a sample chamber where they may interfere with instrument measurements.

Downhole fluids may contain magnetic particles coming from pipe scale, wear of steel components, mud additives, and the like. Instruments for performing measurements on downhole fluids (including most instruments with magnetized components) may have great sensitivity with respect to magnetic particles. That is, when magnetic particles are proximate to the instrument, the results of measurements are tainted. For example, a flexural mechanical resonator will provide inaccurate and/or imprecise results when magnetic particles attach to the permanent magnets of the tine tips. Moreover, once attached, removing the magnetic particles from the tines may be difficult and time consuming. Thus, while performing many types of downhole fluid investigation, it may be beneficial to minimize contamination of the sample with magnetic particles. Unfortunately, a magnetic trap with permanent magnets becomes saturated over time and loses the ability to capture additional particles, thus becoming ineffective as a filter.

Downhole fluid testers of the present disclosure include a switchable magnetic particle filter, which can be periodically cleaned and reactivated. Method aspects may include filtering magnetic particles in downhole fluid by activating the switchable magnetic filter when the downhole fluid enters a sample chamber in the borehole. Method aspects may also include cleaning the switchable magnetic filter by deactivating the switchable magnetic filter. Cleaning the switchable magnetic filter may include removing filtered particles using a fluid.

The teachings may be advantageously applied to a variety of systems in the oil and gas industry, water wells, geothermal wells, surface applications and elsewhere. Merely for clarity, certain non-limiting embodiments will be discussed in the context of tools configured for wellbore uses.

Figure 1:
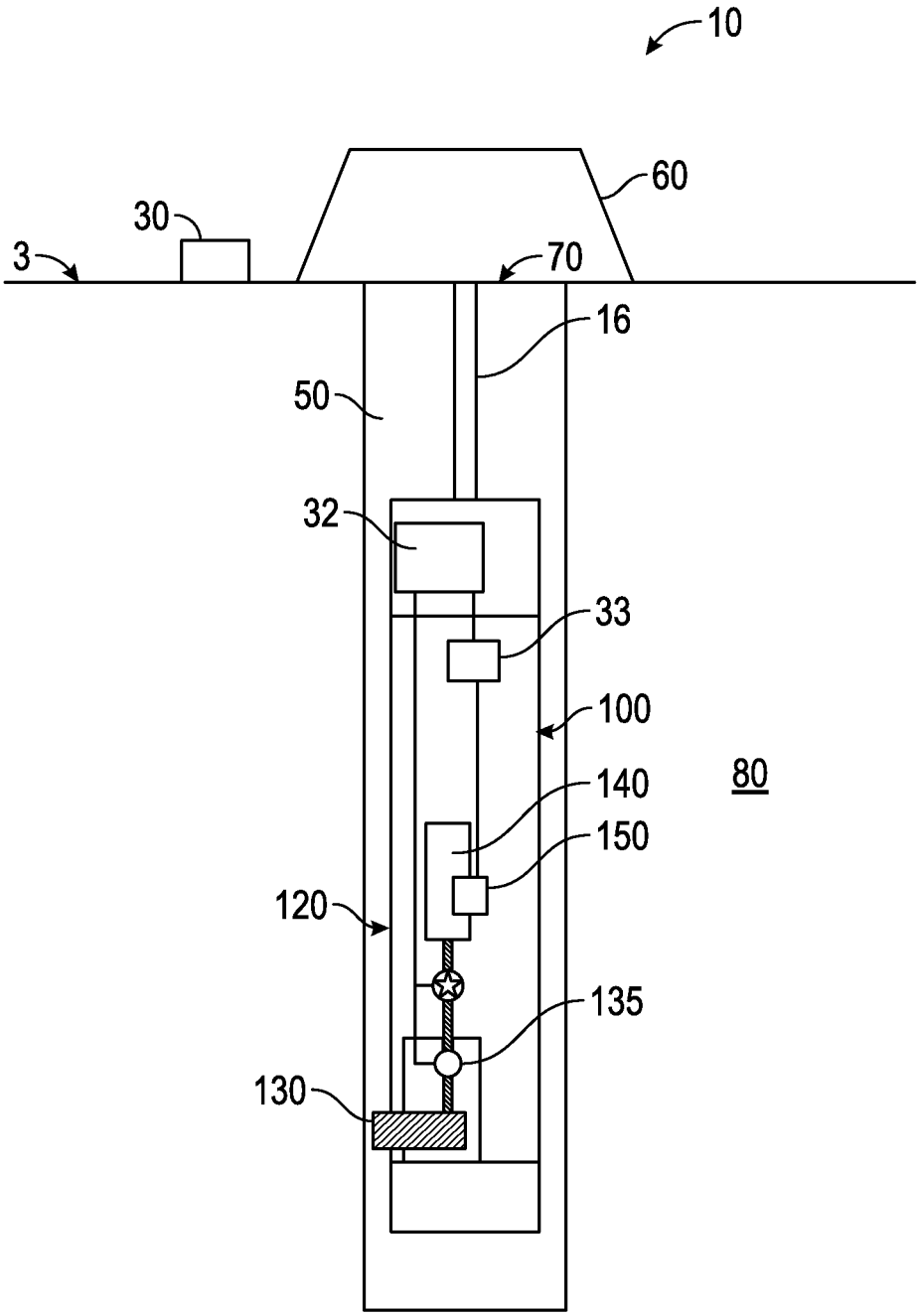
FIG. 1 shows a schematic illustration of a sampling system including a downhole tool in accordance with embodiments of the present disclosure.

FIG. 1 shows a schematic illustration of a sampling system including a downhole tool in accordance with embodiments of the present disclosure. The downhole tool 100 may be used to sample fluids from a desired location e.g., a hydrocarbon bearing reservoir. The system 10 may include a conventional derrick 60 erected on a derrick floor 70. A conveyance device 16 which may be rigid or non-rigid, may be configured to convey the downhole tool 100 into wellbore 50 (also called the borehole) in proximity to formation 80. The conveyance device 16 may be a drill string, coiled tubing, a slickline, an e-line, a wireline, etc. Downhole tool 100 may be coupled or combined with additional tools. Thus, depending on the configuration, the tool 100 may be used during drilling and/or after the wellbore 50 has been formed. While a land system is shown, the teachings of the present disclosure may also be utilized in offshore or subsea applications. The conveyance device 16 may include embedded conductors for power and/or data for providing signal and/or power communication between the surface and downhole equipment. For example, the conveyance device 16 can also provide communications between the downhole tool 100 and a surface controller 30 disposed at the surface of the earth 3. The conveyance device 16 may include a bottom hole assembly, which may include a drilling motor for rotating a drill bit.

System 10 includes a tool 100 that may be conveyed into a borehole 50 intersecting an earth formation 80. The tool 100 may be conveyed through the borehole 50 by a conveyance device 16. The earth formation 80 may include any subsurface material of interest such as a downhole fluid. The downhole tool 100 may include sensors for estimating parameters relating to the formation 80.

In order to operate the downhole tool 100 and/or provide a communications interface with the surface controller 30, the downhole tool 100 may include a downhole controller 32. In one embodiment, electronics (not shown) associated with the sensors may be configured to record information related to the parameters to be estimated. In some embodiments, the parameter of interest may be estimated using the recorded information.

In other embodiments, such electronics may be located elsewhere (e.g., at the surface). To perform estimation of a parameter during a single trip, the tool may use a "high bandwidth" transmission to transmit the information acquired by sensors to the surface for analysis. For instance, a communication line for transmitting the acquired information may be an optical fiber, a metal conductor, or any other suitable signal conducting medium. It should be appreciated that the use of a "high bandwidth" communication line may allow surface personnel to monitor and control the treatment activity in "real time."

In some embodiments, controllers 32, 33 may include mechanical, electromechanical, and/or electrical circuitry configured to control one or more components of the tool 100. In other embodiments, controllers 32, 33 may use algorithms and programming to receive information and control operation of the tool 100. Therefore, controllers 32, 33 may include an information processor that is data communication with a data storage medium and a processor memory. The data storage medium may be any standard computer data storage device, such as a USB drive, memory stick, hard disk, removable RAM, EPROMs, EAROMs, flash memories and optical disks or other commonly used memory storage system known to one of ordinary skill in the art including Internet based storage. The data storage medium may store one or more programs that when executed causes information processor to execute the disclosed method(s). Herein, "information" may include raw data, processed data, analog signals, and digital signals.

In embodiments of the present disclosure, the downhole tool 100 is a downhole fluid sampling tool including sensors for estimating parameters of a downhole fluid. Non-limiting examples of downhole fluids include drilling fluids, return fluids, formation fluids, production fluids containing one or more hydrocarbons, oils and solvents used in conjunction with downhole tools, water, brine, engineered fluids, and combinations thereof. The downhole tool 100 includes fluid tester 120 with a sensor 150 for estimating parameters of a downhole fluid such as, for example, density, viscosity, and/or other parameters. Fluid tester 120 is operatively connected to instrument controller 33 in order to operate the fluid tester 120 and/or provide a communications interface with other controllers. Instrument controller 33 may be incorporated into downhole controller 32, or may be associated with fluid tester 120.

Sensor 150 is sensitive to magnetic particles. That is, when magnetic particles are proximate to the instrument, the results of measurements are tainted. For example, a flexural mechanical resonator will provide inaccurate and/or imprecise results when magnetic particles attach to the permanent magnets of the tine tips. The inaccuracies/imprecision introduced may prohibit making use of the measurements for their intended purpose.

Sensor 150 may include, for example, one or more of a flexural mechanical resonator (FMR) including a magnetic element, for example, for vibrating or oscillating in the downhole fluid with an oscillation characteristic related to the parameter being measured; a nuclear magnetic resonance ('NMR') component used to monitor contamination and analyze fluid samples in fluid sampling tools in a flow line or other sample chamber under downhole conditions; and so on. In other examples, sensor 150 may include any other type of sensor for use with downhole fluids with sensitivity to magnetic particles.

In the embodiment depicted in FIG. 1, the fluid tester 120 includes collector 130 configured to gather a downhole fluid from outside of the tool for analysis downhole. For example, the collector 130 may extract wellbore fluids, formation fluid from the formation 80, and so on. The fluid tester 120 also includes a sample chamber 140 and sensor 150.

The collector 130 includes a fluid mover 135 that sends a sample of the gathered downhole fluids to the sample chamber 140, where sensor 150 takes measurements of the sample. The sensor 150 is in proximity to or in contact with the sample in the sample chamber 140. For example, in the case of an FMR sensor, a portion of the magnetic element is immersed in the downhole fluid in the sample chamber.

The fluid tester further includes a switchable magnetic filter 180 configured to, when activated, filter magnetic particles from downhole fluid entering the sample chamber. The switchable magnetic filter 180 is configured to be disposed within or draped across the flow line where it is installed, so as to extend across the cross section of the flow line and strain fluid flowing therein. The switchable magnetic filter may be further configured to, when deactivated, relax to substantially no magnetization. Switching between activation and deactivation may be performed by downhole controller 32 or instrument controller 33.

In some embodiments, controllers 32, 33 may include mechanical, electromechanical, and/or electrical circuitry configured to control one or more components of the tool 100. In other embodiments, controllers 32, 33 may be implemented in a hardware environment as described below, and use algorithms and programming to receive information and control operation of the tool 100.

Figure 2:
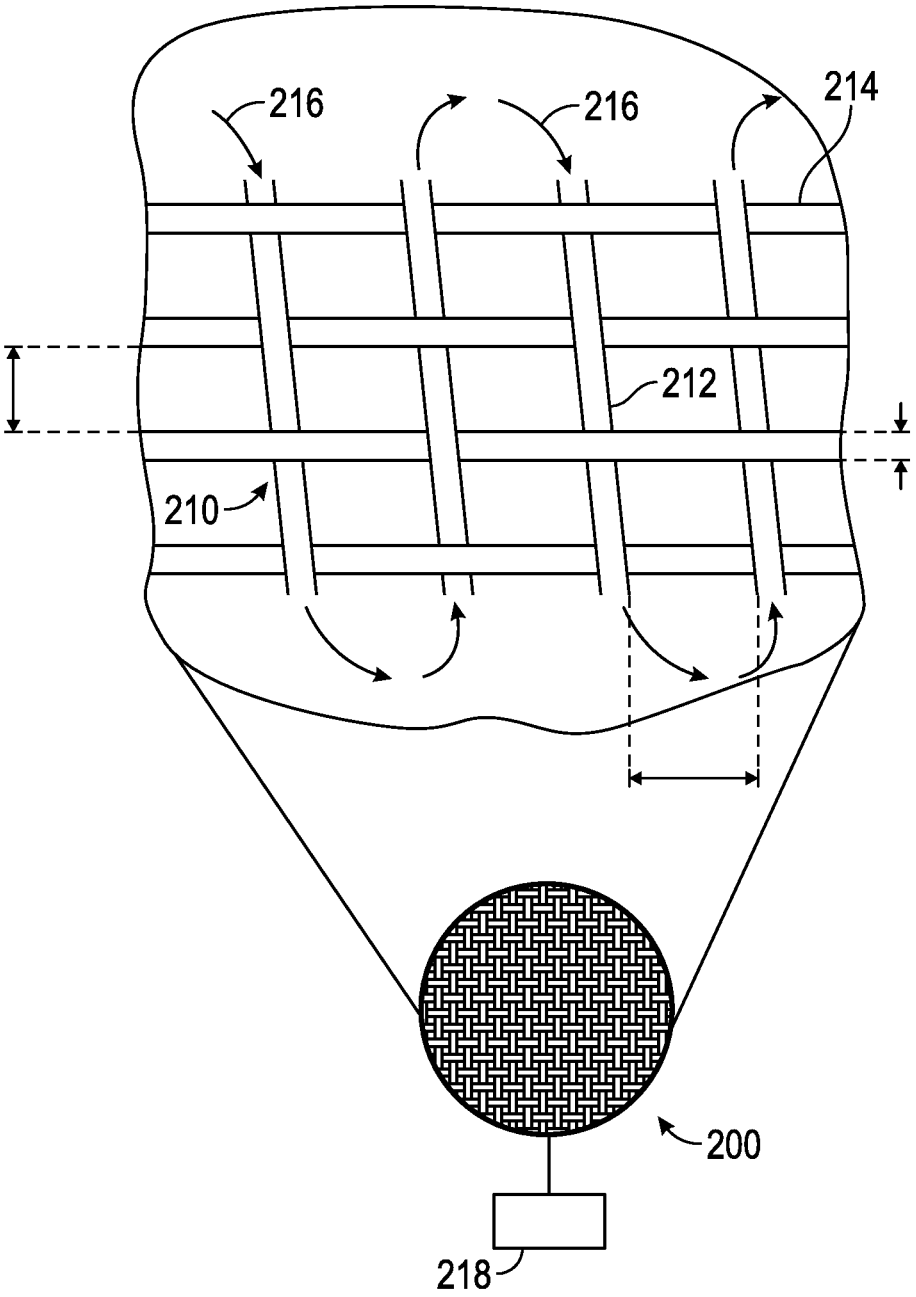
FIG. 2 illustrates a switchable magnetic filter in accordance with embodiments of the present disclosure.

FIG. 2 illustrates a switchable magnetic filter in accordance with embodiments of the present disclosure. The switchable magnetic filter 200 comprises at least one wire mesh 210. The wire mesh 210 includes strands (e.g., wires) of conductor 212 oriented in a first direction; and strands (e.g., wires) of soft magnetic material 214 oriented in a second direction that is different from the first direction. Mesh size (maximum nominal opening dimension) may be approximately 0.5 to 1.0 mm, but may be larger in some applications. Wire diameter may be in the same order of magnitude. Some embodiments may include additional strands in additional orientations.

The conductor strands 212 may be electrically isolated. For example, the conductor strands may be coated with non-conducting material such as plastic, resins, or polymers. This coating or an additional coating may also provide corrosion protection configured to withstand the severe conditions of the downhole environment. The conductor strands 212 may be copper, aluminum, steel, polymer, composite, or other material, as known in the art. The soft magnetic material strands 214 may include ferromagnetic materials based on iron and nickel such as soft magnetic steel, or based on ceramic oxides of metals. A soft magnetic material may be defined as one with little remnant magnetization in the absence of a magnetic field. The magnetic hysteresis loop for such a material may thus be narrow. For example, the soft magnetic material may be non-corrosive magnetic steel. The multiple component mesh is highly efficient.

The switchable magnetic filter is switchable between a magnetic state producing a magnetic field and a non-magnetic state producing substantially no magnetic field. In operation, a current 216 from power source 218 is sent through the conductor strands, which creates magnetic poles in the soft magnetic wires and resulting magnetic field. Any magnetic particle approaching the mesh is attracted and attached to the soft magnetic wires that are magnetized by the current flowing through the conductive (e.g., copper) wires. The current can be switched on as long as needed to draw fluid through the filter. Periodically, the filter may be cleaned by switching off the current and cleaning the filter with fluid (e.g., reversing fluid flow). After the current is switched off, substantially no magnetization remains in the soft magnetic wires and the formerly caught particles are released. The released particles may be flushed from the filter.

The downhole controller 32 and instrument controller 33 may use preprogrammed commands, commands from the surface controller, or combinations of these to control downhole components of tool 100, including the switchable particle filter.

Figure 3:
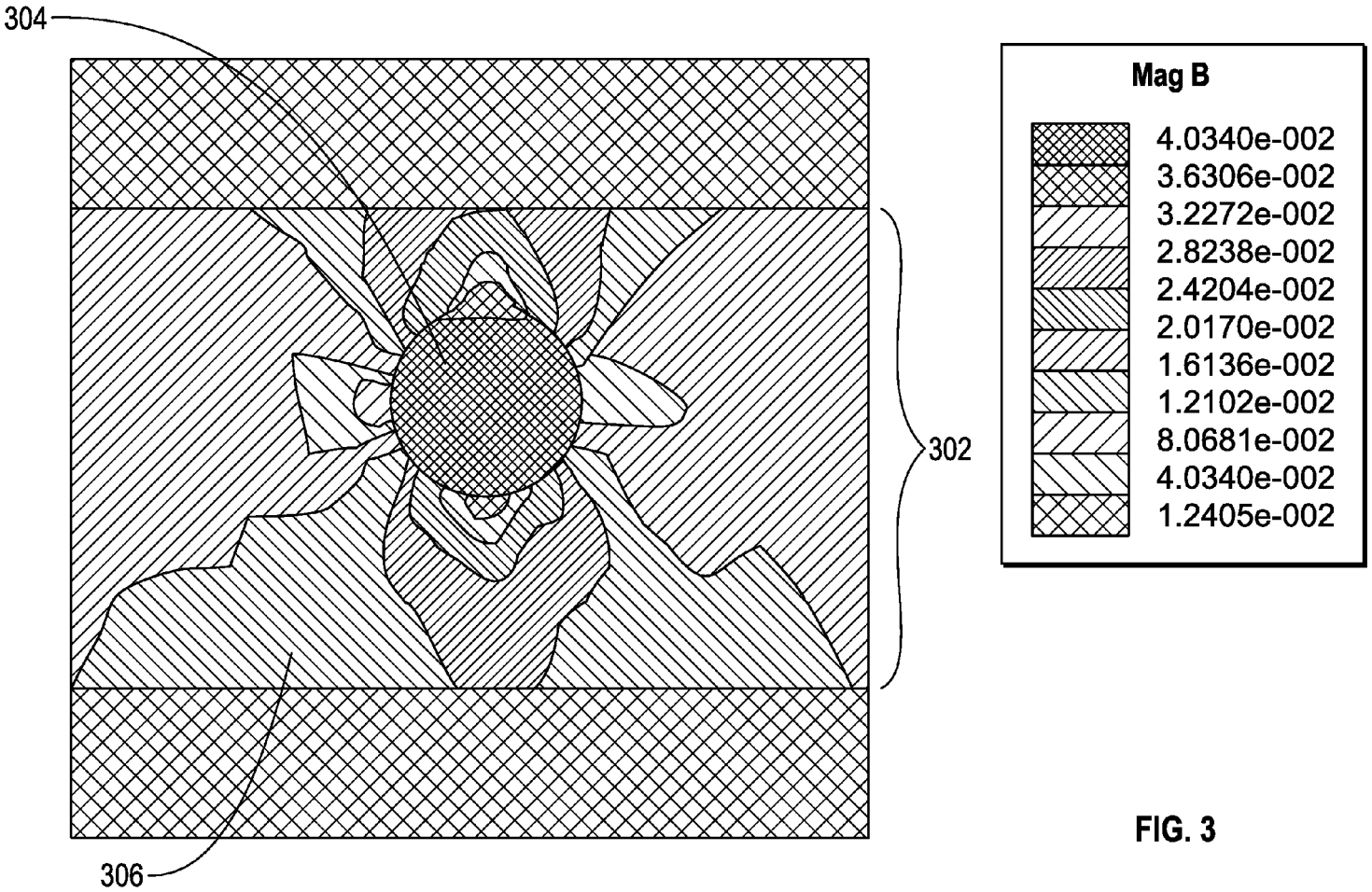
FIG. 3 illustrates a graphic depiction of a gradient field applied to a magnetic particle located between the wires of the switchable magnetic filter in accordance with embodiments of the present disclosure.

FIG. 3 illustrates a graphic depiction of a gradient field applied to a magnetic particle located between the wires of the switchable magnetic filter in accordance with embodiments of the present disclosure. FIG. 3 shows a mesh-hole 302 with an iron particle 304 of 0.1 mm diameter. It is apparent that the particle is in a gradient field sufficient to propel the particle towards a magnetized steel wire.

Figure 4:
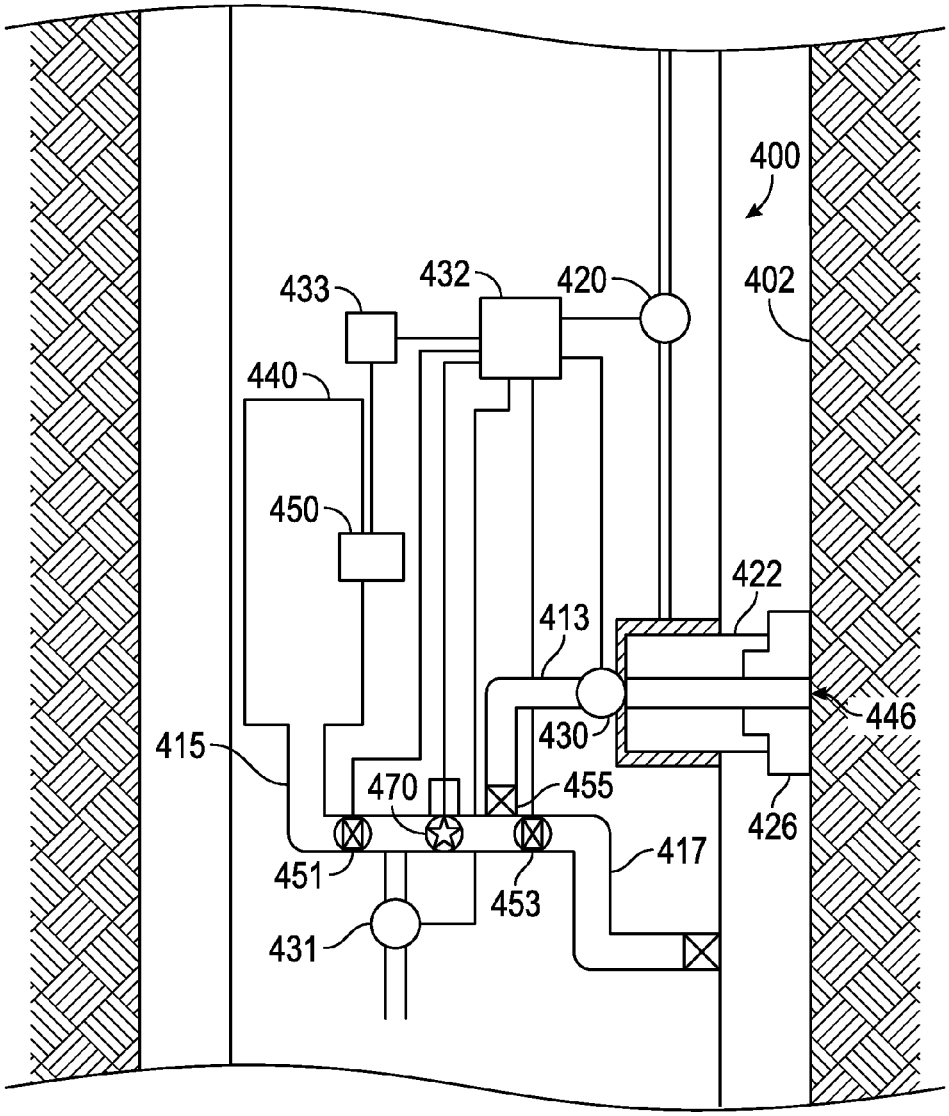
FIG. 4 illustrates a tool including a switchable magnetic filter in accordance with embodiments of the present invention.

FIG. 4 illustrates a tool including a switchable magnetic filter in accordance with embodiments of the present invention. Tool 400 includes a switchable magnetic filter 470 as described above with reference to FIG. 2. Mounted on the tool 400 via a pad piston 422 is a pad member 420 for engaging the borehole wall 402. The pad member 426 may be a soft elastomer (e.g., rubber) cushion. The pad piston 422 is used to extend the pad 426 to the borehole wall 402.

The controller 432 is used to control a plurality of actuators (such as, for example, hydraulic, mechanical, or electrical actuators) to direct fluid flow driven by a fluid mover 420 disposed in the tool 400 to extend a pad piston 422 to press against and engage a section of the borehole wall 402. Fluid mover 430 draws fluid into port 446 and through fluid line section 413. Valve 451 is opened and valve 453 is closed to allow fluid to enter sample chamber 440 via flow line section 415 for measurement using sensor 450.

In particular embodiments, the fluid mover may be a single-action or dual action piston pump. The pumps may be energized by the same power source or independent power sources. The power source may be electric, hydraulic, pneumatic, etc.

Controller 432 also activates the switchable magnetic filter 470 in advance of the downhole fluid entering the sample chamber 440 to filter magnetic particles in the downhole fluid, thereby limiting or eliminating magnetic particles from entering sample chamber 440 or coming into contact with sensor 450. Fluid entering the sample chamber may be tested downhole with one or more sensors 450. After a period of testing, fluid is expelled from the sample chamber 440.

To expel fluid from the sample chamber 440, valve 453 may be opened. Check valve 455 prevents backflow from entering flow line section 413. Downhole fluid contained in the sample chamber may be forced out of the sample chamber using various components such as pumps, additional fluids introduced into the sample chamber, and so on. Periodically, the controller 432 may clean the filter 470 by deactivating the switchable magnetic filter 470 while valve 453 is opened, allowing the magnetic particles to flow into flow line section 417 and into the annulus formed between tool 400 and the wall of the borehole 402. The filtered particles may be removed while the filter 470 is deactivated using sample fluid from sample chamber 440, or other fluid from the borehole or formation (not shown). Filtered particles may also be removed by flushing the filter 470 using an engineered fluid.

Some embodiments may employ multiple switchable magnetic filters 470 in succession in the flow line, with mesh strands in either the same or different orientations with respect to one another. Additional outlets, valves, and exhaust ports (not shown) may be used to flush each filter individually.

In some embodiments, the fluid mover may include a draw piston. The draw piston may be controlled in the "draw" direction by fluid entering a draw line while other fluid exits through a "flush" line. When fluid flow is reversed in these lines, the draw piston travels in the opposite or outward direction. In this way, the system draw piston may flush the system when it is returned to its pre-draw position.

In some drilling embodiments, the tool 400 may include anchoring, stabilizing and sealing elements disposed on a drill string, such as grippers and packers. The controller 432 may control the extension of or engagement of these elements using well-known techniques to seal a portion of the annulus between the drill string and the borehole or to provide drill string stabilization while sampling and testing are performed. When deployed, packers may separate the annulus into an upper annulus, a sampling annulus, and a lower annulus. The creation of the sampling annulus sealed from the upper annulus and lower annulus may provide a smaller annular volume for enhanced control of the fluid contained in the volume.

Additional samples may be drawn and tested in the same location, or the tool may be moved to various locations along the borehole and re-engaged with the borehole wall to draw and test additional samples. In other embodiments, the fluid tester may sample and measure fluid without engagement of the borehole wall.

In some arrangements, the sampling event may be human initiated. For example, sensors may transmit signals representative of one or more selected operating parameters to the surface. Based on these measurements, a human operator may initiate a sampling event. In other arrangements, controllers 30, 32 may be used, alone or in combination, to control the operation of tool 100 to ensure that sample retrieval occurs at desired times and/or at specified conditions.

Figure 5:
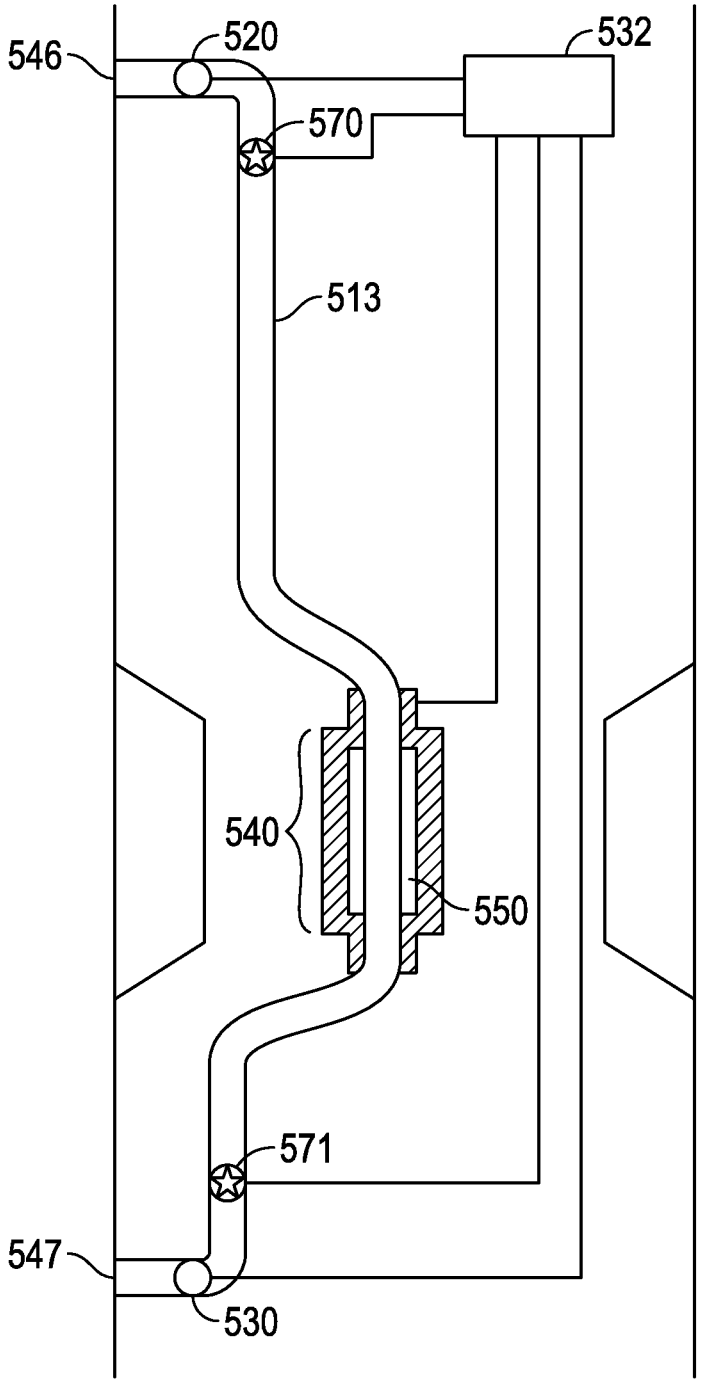
FIG. 5 illustrates another tool including a switchable magnetic filter in accordance with embodiments of the present invention.

FIG. 5 illustrates another tool including a switchable magnetic filter in accordance with embodiments of the present invention. Tool 500 includes a flow line 513 having a switchable magnetic filter 570, 571 (as described above with reference to FIG. 2) proximate to each end of the flow line.

A controller 532 is used to control a plurality of actuators (such as, for example, hydraulic, mechanical, or electrical actuators) to direct fluid flow driven by fluid movers 520, 530 disposed in the tool 500. In nominal operation (forward flow), fluid mover 520 draws fluid into port 546 and through fluid line 513 to allow fluid to enter sample chamber 540 for measurement using NMR sensor 550. Sample chamber 540 may be a segment of flow line 513 adjacent to sensor 550. From there, fluid leaves sample chamber 540 via fluid line 513 and eventually leaves tool 500 via exit port 547. Flow through the sample chamber 540 may be continuous or may slow or stop during measurement by the sensor 550, either by slowing or stopping the fluid movers or by diverting flow around the sample chamber (not shown).

Controller 532 also activates switchable magnetic filter 570 and deactivates switchable magnetic filter 571 during nominal operation, so that activated switchable magnetic filter 570 filters magnetic particles in the downhole fluid entering port 546 before the fluid enters sample chamber 540 or coming into contact with sensor 550. Fluid entering the sample chamber 540 is tested downhole with sensor 550, before being expelled from the sample chamber 540 via port 547.

Periodically, the controller 532 may clean the switchable magnetic filter 570 by deactivating the filter 570 and causing flow in line 513 to be reversed. Switchable magnetic filter 571 may be activated during reverse flow to avoid contamination of the sample chamber from fluid entering port 547. Alternatively, switchable magnetic filter 570 may be flushed with engineered fluid from a separate reservoir (not shown) and thereby washed out of port 546 and allowed to disperse.

Figure 6:
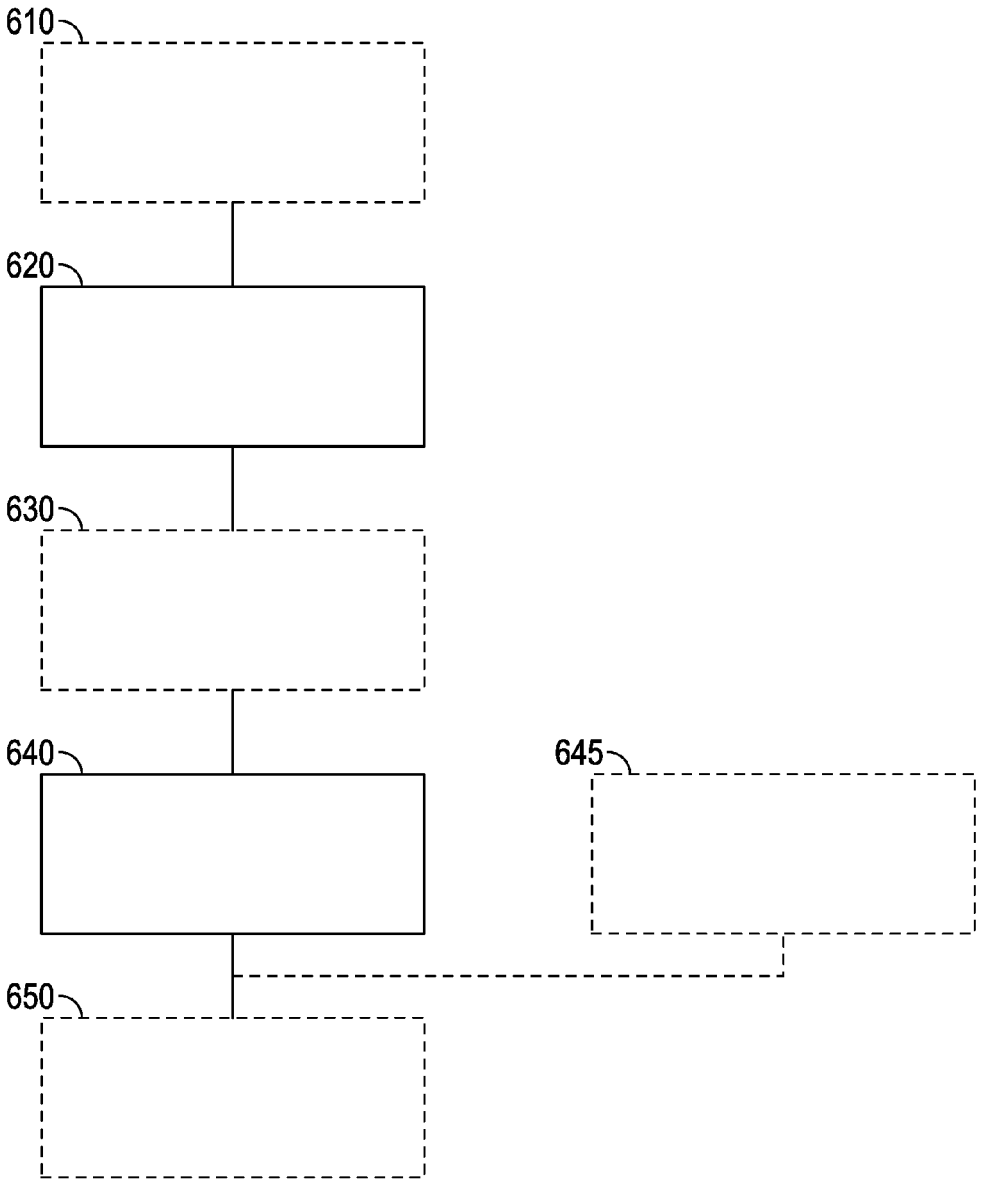
FIG. 6 shows, in flow chart form, one method according to the present disclosure for evaluating a downhole fluid from a formation intersected by a borehole.

FIG. 6 shows, in flow chart form, one method 600 according to the present disclosure for evaluating a downhole fluid from a formation intersected by a borehole. Method 600 may include optional step 610, conveying a downhole fluid testing tool into a borehole. At step 620, the method includes filtering magnetic particles in a downhole fluid by activating a switchable magnetic filter when the downhole fluid enters a sample chamber in the borehole. The switchable magnetic filter may be switchable between a magnetic state producing a magnetic field and a non-magnetic state producing substantially no magnetic field.

At optional step 630, information relating to the downhole fluid in the sample chamber is collected using a sensor associated with the sample chamber. At step 640, the method includes cleaning the switchable magnetic filter by deactivating the switchable magnetic filter. Cleaning the switchable magnetic filter may further include removing filtered particles using a fluid. The fluid may be at least one of: i) the downhole fluid; and ii) engineered fluid. At optional step 650, the method may include estimating a parameter of interest of the downhole fluid in the sample chamber using the collected information. The information may be applied to a model relating sensor information to the parameter of interest, and may also include comparison or combination of the information with reference information about the formation. In some embodiments, method 600 may include step 645, where reference information on the formation or formations generally is accessed.

In support of the teachings herein, various analysis components may be implemented in a hardware environment. For example, the downhole electronics, controllers 30, 32, 33, 432, 433, 532, sensors 150, 450, 550, and the like may include a digital and/or analog hardware environment.

Herein, the term "information" may include one or more of: raw data, processed data, and signals.

The term "conveyance device" as used in this disclosure means any device, device component, combination of devices, media and/or member that may be used to convey, house, support or otherwise facilitate the use of another device, device component, combination of devices, media and/or member. Illustrative conveyance devices include wirelines, wireline sondes, slickline sondes, e-lines, jointed drill pipe, coiled tubing, wired pipe, casing, liners, drop tools, and so on.

As used herein, the term "fluid" and "fluids" refers to one or more gasses, one or more liquids, and mixtures thereof.

A "downhole fluid" as used herein includes any gas, liquid, flowable solid and other materials having a fluid property, and relating to hydrocarbon recovery. A downhole fluid may be natural or man-made and may be transported downhole or may be recovered from a downhole location. Non-limiting examples of downhole fluids include drilling fluids, return fluids, formation fluids, production fluids containing one or more hydrocarbons, oils and solvents used in conjunction with downhole tools, water, brine, and combinations thereof.

An "engineered fluid" may be used herein to mean a fluid formulated for cleaning the switchable magnetic filter of magnetic particles. The engineered fluid is stored separately from downhole fluids.

By substantially no magnetic field, it is meant magnetic field at a level sufficiently low to allow a portion of particles to fall off such that the switchable magnetic filter may be used indefinitely continuously with periodic cleaning without decline in effectiveness, examples of such a portion including, for example, at least 90 percent, at least 95 percent, at least 99 percent, at least 99.9 percent, and so on, up to an including all particles, with examples of such a magnetic force including, for example, fewer than 1 millitesla, 0.5 millitesla, 0.1 millitesla, and so on, down to and including zero magnetic pull.

As used herein, a processor is any information processing device that transmits, receives, manipulates, converts, calculates, modulates, transposes, carries, stores, or otherwise utilizes information. In several non-limiting aspects of the disclosure, an information processing device includes a computer that executes programmed instructions for performing various methods. These instructions may provide for equipment operation, control, data collection and analysis and other functions in addition to the functions described in this disclosure. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on.

While the foregoing disclosure is directed to the one mode embodiments of the disclosure, various modifications will be apparent to those skilled in the art. It is intended that all variations be embraced by the foregoing disclosure.

What is claimed is:

1. A method for evaluating a downhole fluid from a formation intersected by a borehole, the method comprising:

filtering magnetic particles in downhole fluid by activating a switchable magnetic filter comprising at least one wire mesh when the downhole fluid enters a sample chamber in the borehole, wherein the at least one wire mesh comprises strands of conductor oriented in a first direction and strands of soft magnetic material oriented in a second direction that is different from the first direction; and wherein activating the switchable magnetic filter comprises creating a magnetic field generated by magnetic poles in the strands of soft magnetic material, the magnetic poles resulting from an electrical current sent through the strands of conductor.

2. The method of claim 1 further comprising cleaning the switchable magnetic filter by deactivating the switchable magnetic filter.

3. The method of claim 2 wherein cleaning the switchable magnetic filter further comprises removing filtered particles using a fluid.

4. The method of claim 3 wherein the fluid is at least one of: i) the downhole fluid; and ii) engineered fluid.

5. The method of claim 1 further comprising estimating a parameter of interest of the downhole fluid in the sample chamber.

6. The method of claim 1 wherein the conductor strands are electrically isolated.

7. The method of claim 1 wherein the switchable magnetic filter is switchable between a magnetic state producing a magnetic field and a non-magnetic state producing substantially no magnetic field.

8. The method of claim 1 wherein the downhole fluid comprises formation fluid.

9. The method of claim 1 wherein the magnetic field generated by magnetic poles in the strands of soft magnetic material causes magnetic particles in the downhole fluid to attach to the strands of soft magnetic material.

10. A formation evaluation apparatus comprising:

a sample chamber configured to receive downhole fluid;

a switchable magnetic filter including at least one wire mesh comprising strands of conductor oriented in a first direction and strands of soft magnetic material oriented in a second direction that is different from the first direction;

the switchable magnetic filter configured to, when activated by creating a magnetic field generated by magnetic poles in the strands of soft magnetic material resulting from an electrical current sent through the strands of conductor, filter magnetic particles from downhole fluid entering the sample chamber by attracting the magnetic particles to the strands of soft magnetic material.

11. The apparatus of claim 10 wherein the switchable magnetic filter is further configured to, when deactivated, relax to substantially no magnetization.

12. The apparatus of claim 10 further comprising a sensor responsive to a parameter of interest of the downhole fluid in the sample chamber and sensitive to magnetic particles.

* * * * *